US008028345B2

(12) United States Patent
Waite et al.

(10) Patent No.: US 8,028,345 B2
(45) Date of Patent: Oct. 4, 2011

(54) TENNIS GARMENT WITH BALL SLEEVES

(75) Inventors: Lance Waite, Encinitas, CA (US); Anna Waite, Encinitas, CA (US)

(73) Assignee: Rockport Recreation Co., LLC, Encinitas, CA (US)

( * ) Notice: Subject to any disclaimer, the term of this patent is extended or adjusted under 35 U.S.C. 154(b) by 0 days.

(21) Appl. No.: 12/156,799

(22) Filed: Jun. 4, 2008

(65) Prior Publication Data

US 2009/0300818 A1 Dec. 10, 2009

(51) Int. Cl.
*A41D 13/00* (2006.01)
*A41F 27/20* (2006.01)

(52) U.S. Cl. ..... 2/69; 2/228; 2/227; 2/220; 2/247

(58) Field of Classification Search ..... 2/69, 228, 2/238, 227, 220, 221, 338, 310–312, 247–254
See application file for complete search history.

(56) References Cited

U.S. PATENT DOCUMENTS 2,508,190 A 5/1950 Previdi
3,744,059 A * 7/1973 Hayes ..... 2/250
3,871,030 A 3/1975 Green
4,079,871 A 3/1978 Sica
4,413,762 A 11/1983 Carini
4,416,404 A 11/1983 Daniels
4,433,803 A 2/1984 Liberboim
4,603,441 A 8/1986 Richter
5,031,244 A * 7/1991 Inagaki ..... 2/102
5,064,107 A 11/1991 Ascarrunz
5,636,386 A 6/1997 Salamone
5,724,679 A 3/1998 Hans
5,870,777 A 2/1999 Hans
6,041,445 A 3/2000 Davitt
6,772,446 B1 8/2004 Black
6,993,940 B2 2/2006 Rabinowicz et al.

* cited by examiner

*Primary Examiner* — Gloria Hale
(74) *Attorney, Agent, or Firm* — Kent M. Walker

(57) ABSTRACT

A tennis garment of fabric material and sewn construction has a front panel sewn to a rear panel with a waistband encircling the garment. A ball securing sleeve is aligned with, and joined to, the rear waistband portion at left, central, and right mutual locations, thereby establishing two ball securing sleeves into which a tennis ball may be inserted from above or below the sleeve. Once inserted, the ball is held in place by opposing upper and lower elastic bands within upper and lower hems of the sleeves. When desired, the ball may be withdrawn from the sleeves by upward or downward movement relative to the sleeves.

5 Claims, 6 Drawing Sheets

TENNIS GARMENT WITH BALL SLEEVES

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

SEQUENCE LISTING

Not applicable.

BACKGROUND OF THE INVENTION

1. Field of the Present Disclosure

This disclosure relates generally to garments that are used to secure and carry balls such as in the games of tennis and golf wherein the balls should be readily accessible and yet not protrude in a manner that might limit the necessary motions of the player. Especially in the game of tennis, while serving, it is desirable to carry at least two balls in addition to a first ball held by hand. Frequently, a service may use two balls, but often may require three when considering "net," "out," and "let" balls. Of course more than three balls may be needed in a given service, but this is less common. It is therefore desirable to maintain concentration by having additional balls immediately handy. Therefore, the balls should be carried by the garment and yet remain accessible but not physically intrusive on body and arm motions during play. Such garments may include tennis clothing, belts, vests and other solutions.

2. Description of Related Art Including Information Disclosed Under 37 CFR 1.97 and 1.98

Previdi, U.S. Pat. No. 2,508,190, discloses a belt having an outer pocket formed of adjacent front and rear walls with the front wall formed with a horizontal elongated pocket opening closed by a slide fastener, an inner pocket for golf balls within the outer pocket, comprising a back piece of material secured along its top edge to the inside face of the front wall of the outer pocket above the pocket opening to depend across the pocket opening with the outer pocket, and a front piece of material secured along its side and bottom edges to the face of the back piece of material adjacent the inner face of the front wall of the outer pocket, the front piece of material being of less height than the back piece of material and secured to the back piece so as to have its top edge normally below the pocket opening of the outer pocket, the inner pocket being of a width less than the length of the pocket opening and secured to the inside face of the front wall of the outer pocket midway of the length of the pocket opening, whereby when the pocket opening is open the inner pocket while containing golf balls may be drawn through the pocket opening to depend along the out face of the front wall of the outer pocket facilitating insertion and removal of the golf balls from the inner pocket.

Green, U.S. Pat. No. 3,871,030, discloses a woman's tennis panty which is provided with quick access pockets adjacent the leg passages in the panty, each pocket constructed to securely hold an object, such as a tennis ball, in such a manner that it will not impede the movement of the wearer, nor be ejected by body movements of the wearer of the garment.

Sica, U.S. Pat. No. 4,079,871, discloses a belt-type garment for carrying tennis balls and the like. A belt portion has front and rear surfaces and devices thereon for removably fastening the belt portion around the waist of a wearer. A longitudinally extending pocket portion is provided for carrying at least one of the balls and has front and rear sections joined at the bottoms and sides thereof to define a generally U-shaped, transverse, cross-sectional configuration. The top of the rear section is secured to the rear surface of the belt portion in a pleated arrangement for defining a plurality of successive pleats extending downwardly therefrom. An elongate elastic strip is secured in the stretched condition to the top of the front section of the pocket portion for defining, when the elastic strip is relaxed, a plurality of successive gathers extending downwardly from the top of the front section. The pleats in the rear section of the pocket portion will reduce the bulk of the pocket portion between the rear surface of the belt portion and the wearer. The gathers in the front section of the pocket portion and the elastic strip secured to the top thereof will allow an evenly distributed expansion of the top of the front section of the pocket portion for ease in insertion and removal of the ball and for holding the ball in the pocket portion. The pleats in the rear section and the gathers in the front section of the pocket portion will provide for expansion thereof for containing the ball.

Carini, U.S. Pat. No. 4,413,762, discloses a game ball holder for holding a ball, such as a tennis ball, on a garment. The holder includes two elongate strips of elastic material arranged side by side with one lateral edge of one strip adjacent to one lateral edge of the other. The adjacent lateral edges are joined together along a prescribed length from each end and un-joined for a prescribed length midway between the ends. The strips are either attached directly to a garment or attached to a base of cloth material which, in turn, is attached to the garment.

Daniels, U.S. Pat. No. 4,416,404, discloses a belt type garment for carrying tennis balls and the like that comprises a belt portion having on one extremity devices thereon for removably fastening the belt portion around the waist of the wearer. A tubular section for carrying at least one of the balls has its longitudinal seam secured to the rear surface of the belt such that the belt passes through the tubular section longitudinally at the inner circumference. At opposite extremities of the tubular section, symmetrical orifices with throats constricted transversely to the tubular axis by elongate elastic strips which are secured to the inner circumference at each throat station in the stretched condition such that when the elastic is relaxed, a plurality of successive gathers extends circumferentially at each throat forming between them the storage compartment and adjacently an infundibuliform orifice with a forward facing semi-elliptical perimeter. The elastically constricted throats allow for ease of insertion and removal of the balls while at the same time providing a secure compartment for retaining the balls during play.

Liberboim, U.S. Pat. No. 4,433,803, discloses a tennis ball holder belt having suitable fasteners to connect the belt on a tennis player and the belt having at least two ball holder panels attached thereto. The panels can be either permanently sewn to the belt or be temporarily affixed by means of snaps or other fasteners. Each panel has pockets for holding at least six tennis balls. In the conventional pocket arrangement, each panel has three upwardly facing pockets and three downwardly facing pockets. Alternatively, elastic strips attached to the panels are used as pockets, preferably with reticulated polymer surface therein to assist in retaining the tennis balls within the elastic pocket.

Richter, U.S. Pat. No. 4,603,441, discloses a sport garment for women that has an outer side and an inner side and comprises a fabric piece having a maximum dimension perpendicular to a centerline, an upper edge extending both ways therefrom from a first garment end to a second garment end, a lower edge including a curved central portion defining a central garment portion symmetrical with respect to the centerline and having a center of curvature above the lower edge and first and second end portions extending from the central portion to the first and second garment ends and defining first and second garment end portions, respectively, first and second pockets, each sized to receive a plurality of tennis balls, on the central portion on the outer side of the garment and symmetrical with respect to the centerline. Each pocket has an opening facing the upper edge. The garment end portions are releasably joinable about a wearer's waist with the inner side confronting the wearer's body. The garment may be worn with the central portion on that hip of the wearer selected by the wearer so that one of the pockets is on the front of the wearer's body and accessible to the hand of the wearer selected by the wearer.

Ascarrunz, U.S. Pat. No. 5,064,107, discloses a device that can be carried by a tennis player, which allows the player to easily store and receive tennis balls. The device includes a substantially rigid tubular member whose inside closely surrounds a standard size tennis ball, and which has a wide slot at one side through which a tennis ball can pass when resiliently deformed. With the tubular member at the player's back at waist level, the player can place a ball anywhere against the slot and press the ball through the slot into the tubular member, or reach through the slot to grasp a ball and pull it out through the slot or through an open end of the tubular member.

Salamone, U.S. Pat. No. 5,636,386, discloses a tennis skirt having a pocket hidden within a pleated, partially tacked down, knife edge tennis skirt. The pocket is hidden within the upper, tacked down portion of the pleat. Due to the unique manufacturing process of the present invention, the resulting tennis skirt provides a hidden pocket which is rugged in construction and can attractively hold tennis balls, keys and other items, without detracting from the continuous cascading pleated look of the tennis skirt. In addition a step-by-step method of manufacturing a garment, specifically a tennis skirt having a tacked down knife edge pleats with a hidden pocket is also disclosed.

Hans, U.S. Pat. No. 5,724,679, discloses a pair of athletic pants having a front panel, a back panel attached to the front panel and a pocket attached to the back panel. The pocket has an inner layer and an outer layer, the inner layer being composed of mesh. In a preferred embodiment, the outer layer is also composed of mesh.

Hans, U.S. Pat. No. 5,870,777, discloses a single layer pocket in which left edge portion and right edge portion of the single layer are spaced apart from the left edge portion and right edge portion of the back panel. The pocket is equipped with a flexibly rigid curvilinear shaped rib element affixed vertically to the pocket, and a similar rib element that extends laterally across the pocket.

Davitt, U.S. Pat. No. 6,041,445, discloses an adaptive undergarment for persons with specialized urological needs. The adaptive undergarment provides an elongate pocket for storing specialized urological articles. The elongate pocket is located preferably in a parallel spaced relationship with the waistband of the user's undergarment. The adaptive undergarment may have an additional pocket elsewhere on the undergarment for storing items such as antibacterial wipes. Each pocket is open at one edge to receive and provide access to the stored items. Any type of undergarment conforming to any user's specialized urological needs is adaptable into this adaptive undergarment.

Black, U.S. Pat. No. 6,772,446, discloses a women's undergarment that includes a fabric body having a back, a front, side portions connecting the front and the back, a top, a bottom and a crotch. A waistband is secured to the top of the fabric body, and leg openings are provided at the bottom of the fabric body separated by the crotch. Pocket structure is connected to and coextensive with the side portions of the fabric body. The pocket structure has side edges attached to a bottom edge and a top edge. Either the top edge or the bottom edge is open. The pocket structure is sized and shaped to receive a women's sanitary pad through the open edge.

Rabinowicz et al., U.S. Pat. No. 6,993,940, discloses a tennis vest that is formed from a circularly knit fabric tube having an extended turned welt at a bottom region of the vest to form outer and inner plies. The plies are sewn together along longitudinal lines to form two pockets. A pair of openings are knitted into the outer ply, each opening associated with one pocket. The pockets and openings are sized to accommodate a tennis ball in each pocket. The pockets are preferably located on a rear side of the garment.

The related art described above discloses several solutions to the need for carrying more than one ball in the game of tennis. Several approaches are suggested. One approach is to provide a belt with pockets that may be strapped around the waist. This solutions is bulky and unsightly. A second approach is to provide pockets in standard garments worn during play. Liberboim U.S. Pat. No. 4,433,803 teaches the use of pockets that may be loaded from above, and also pockets that may be loaded from below; both pockets having an elastic pocket opening that prevents a ball from leaving the pocket until manually removed. However, standard pockets suffer from the problem that the ball must be retrieved from the pocket's one opening, and this may be difficult when the pocket is located behind the back; for instance, in trying to lift a ball up and out of the pocket by bending the arm behind the back with bent elbow and arm extending across the back. Frequently there is aggressive engagement between the fabric of the pocket and the fuzzy cover of the ball so that upon attempting to retrieve the ball, the pocket may attempt to hold the ball back or turn inside-out. Of particular interest is Carini U.S. Pat. No. 4,413,762 which teaches the use of dual elastic straps for capturing a tennis ball. However, Carini fails to teach how the ball may be absolutely secured since the positions of the straps are critical to the balls' securement. With one of the straps positioned too high or too low, the ball may be easily jarred loose. With the straps spread too far apart, the ball may squeeze through them. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A tennis garment of fabric material and sewn construction has a front panel sewn to a rear panel with a waistband encircling the garment. The garment may be a tennis dress, skirt or shorts. A ball securing band is aligned with, and joined to, the rear waistband portion at left, central, and right locations, thereby establishing two ball securing sleeves into each of which a tennis ball may be inserted from above or below the band. Once inserted, the ball is held in place by opposing upper and lower elastic cords that are sewn into upper and lower hems of the band. When desired, a ball may be placed in or withdrawn from either of the sleeves by pulling the ball upward or downward from the sleeves.

An objective of the present invention is to provide a means for securing tennis balls on a tennis garment that otherwise does not appear to provide a ball holding device.

A further objective is to secure the tennis balls in a manner that enables inserting and removing the balls from above and also from below a sleeve integral with the garment and positioned at the waist.

A still further objective is to provide means for holding one or two balls that may be accessed from below a sleeve.

A still further objective is to provide an extensible sleeve that utilizes the gathering of garment fabric to determine the maximum extent of expansion of a ball entrance/exit in a sleeve that is urged into a closed attitude by an elastic cord.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in several of its preferred embodiments, which are further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
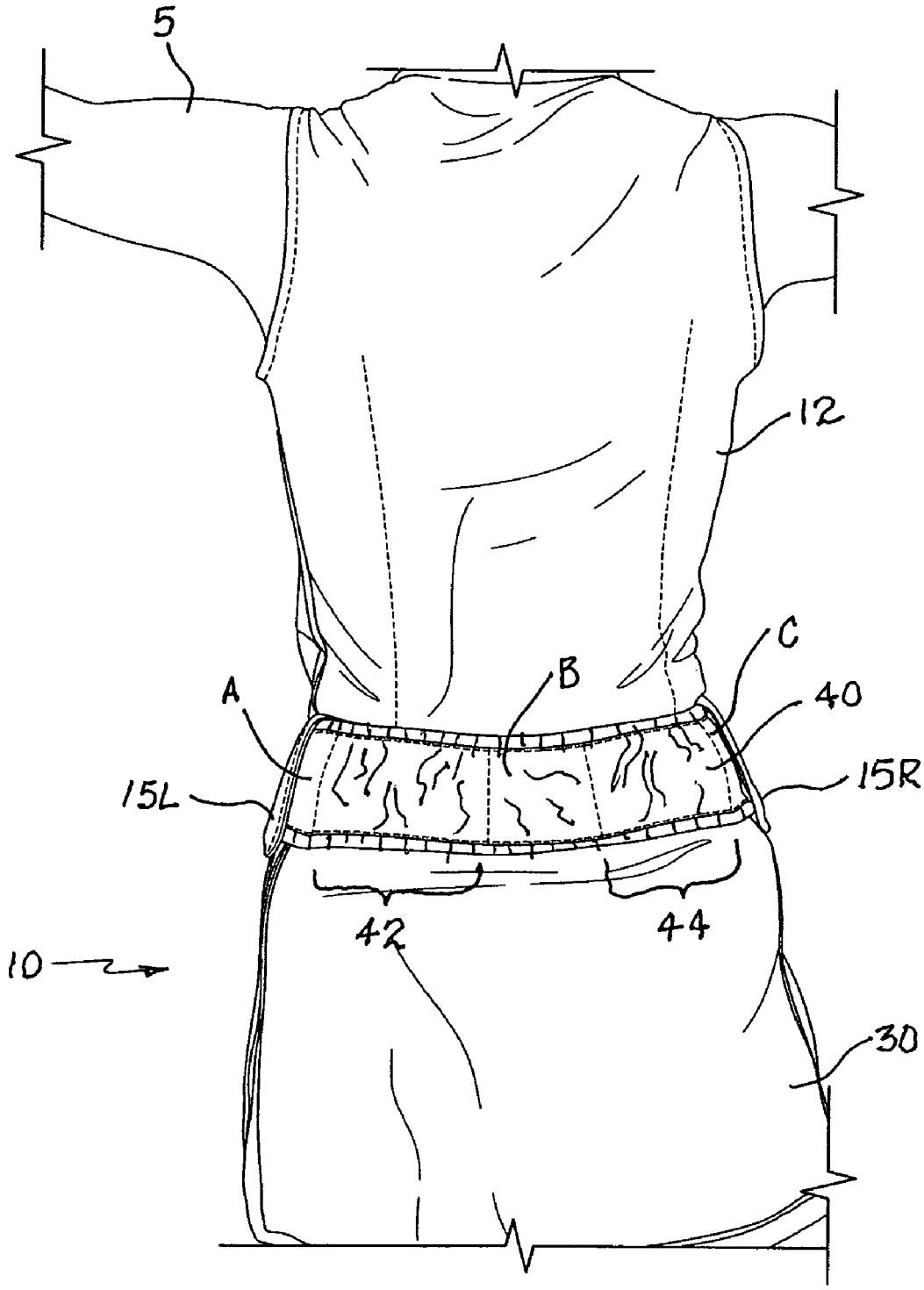
FIG. 1 is a rear elevational view of a tennis dress showing a ball securing sleeve of the present invention.
Figure 2:
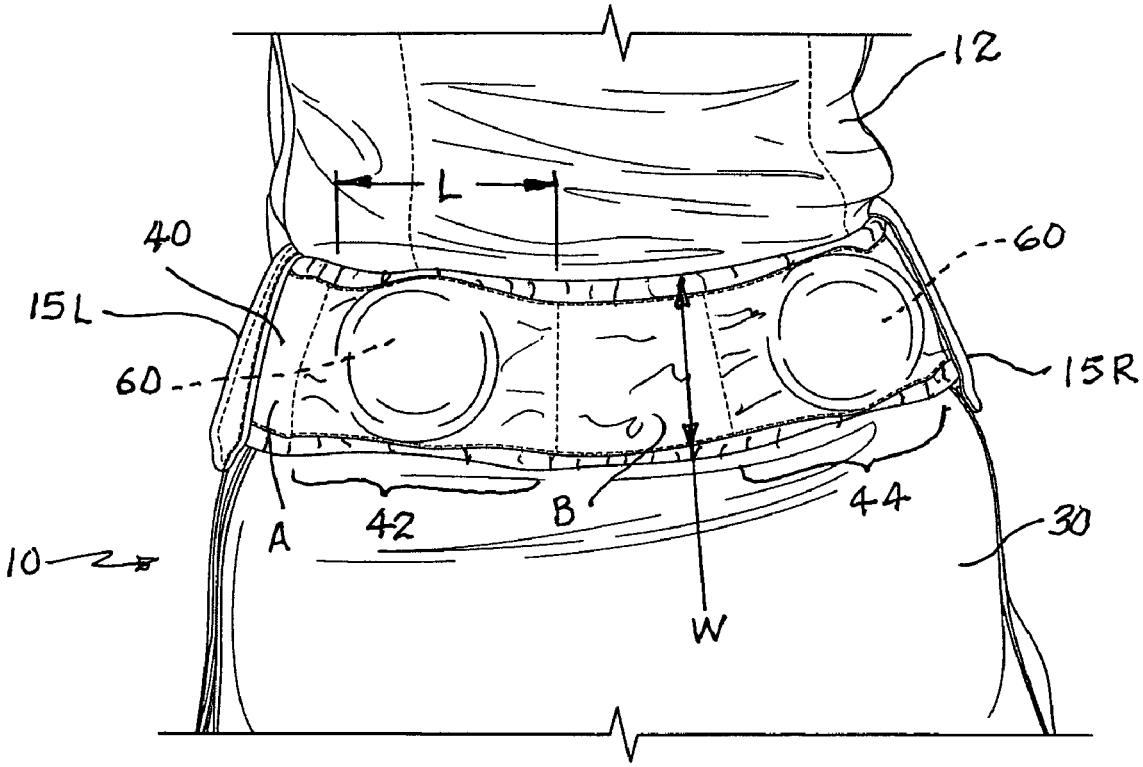
FIG. 2 is a partial elevational view thereof showing tennis balls secured by the ball securing sleeve.
Figure 3:
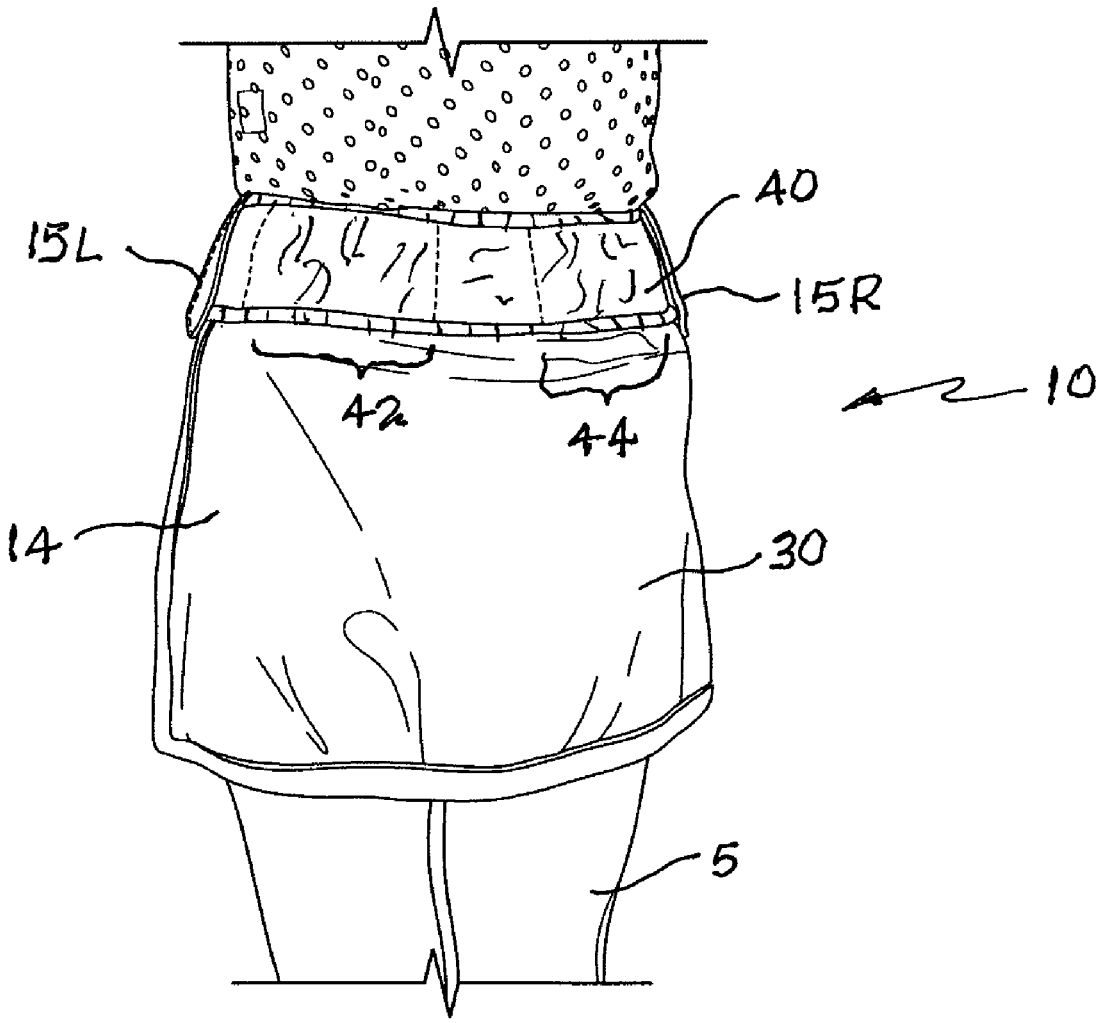
FIG. 3 is a rear elevational view of a tennis skirt in accordance with the present invention.
Figure 4:
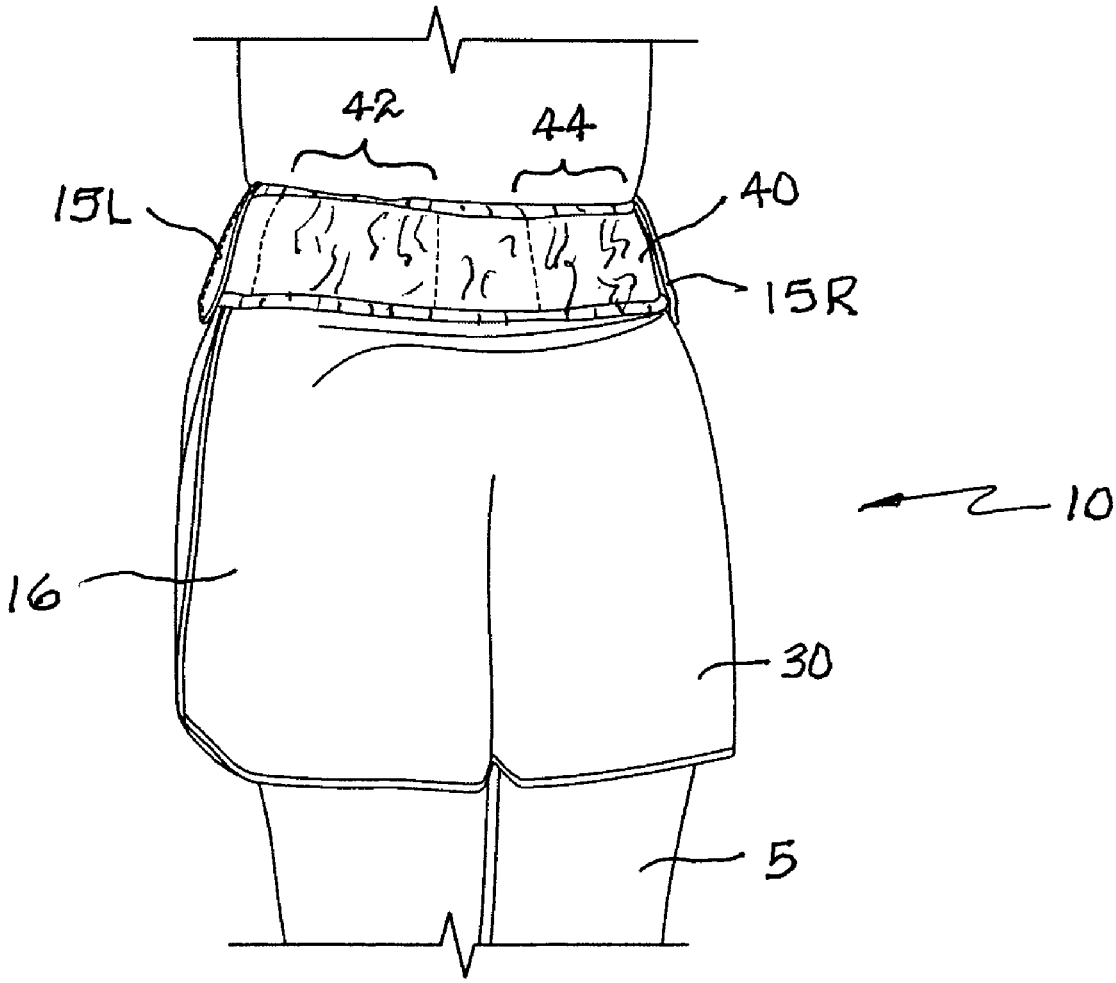
FIG. 4 is a rear elevational view of a tennis shorts in accordance with the present invention.
Figure 5:
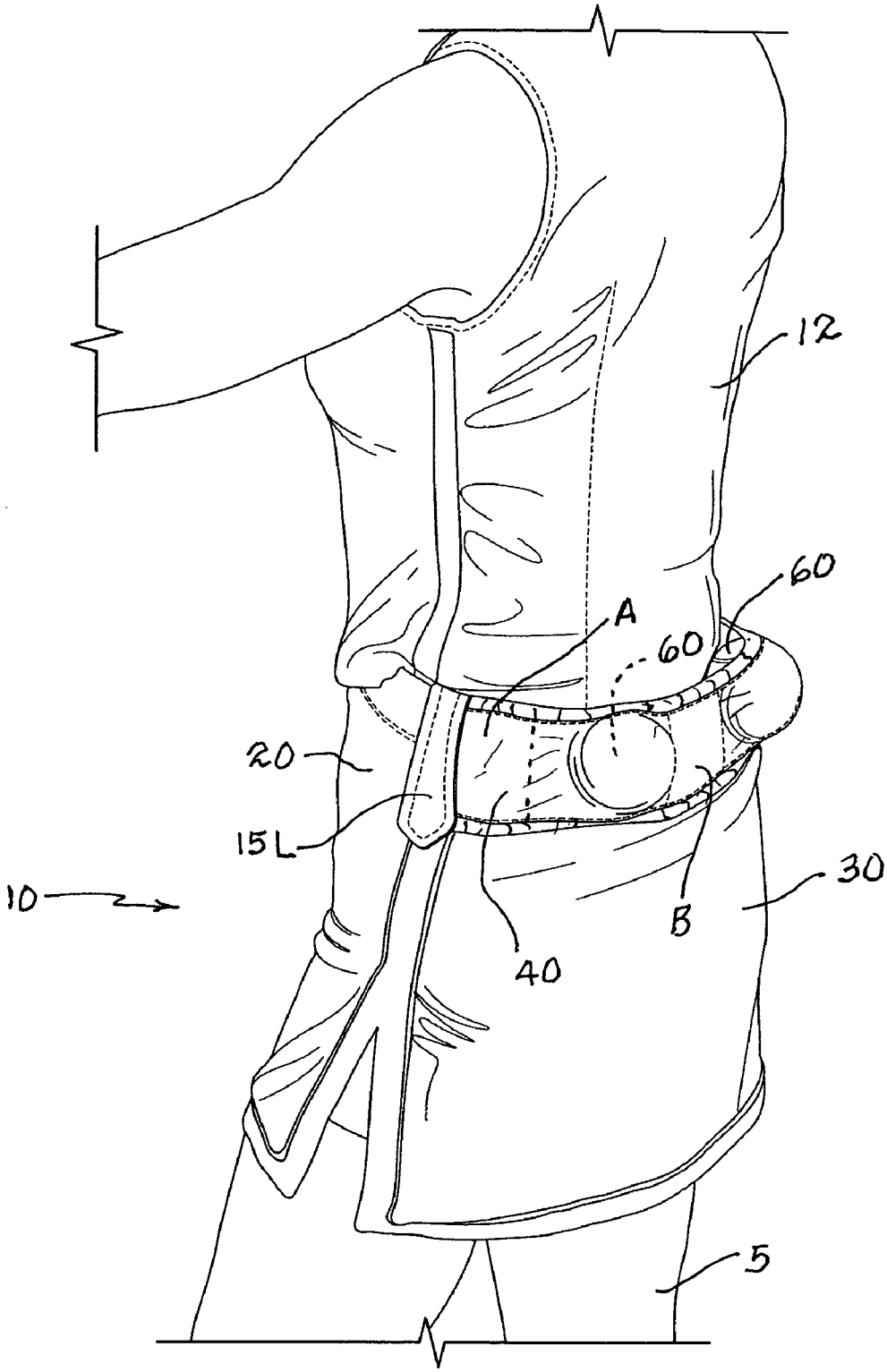
FIG. 5 is a side perspective view of the tennis dress with tennis balls secured by the ball securing sleeve.

The present invention is a tennis garment 10 of fabric material and sewn construction for use by a tennis player 5. The garment 10 may be a tennis dress 12 as shown in FIGS. 1, 2 and 5, a tennis skirt 14, as shown in FIG. 3 or tennis shorts 16 as shown in FIG. 4. In each case the garment 10 is constructed with a front panel 20 joined to a rear panel 30. The front and rear panels 20, 30 are respectively joined to a waistband having corresponding front 22 and rear 32 portions, the waistband portions being joined together to encircle a waist of the tennis player 5. See FIG. 6.

Figure 6:
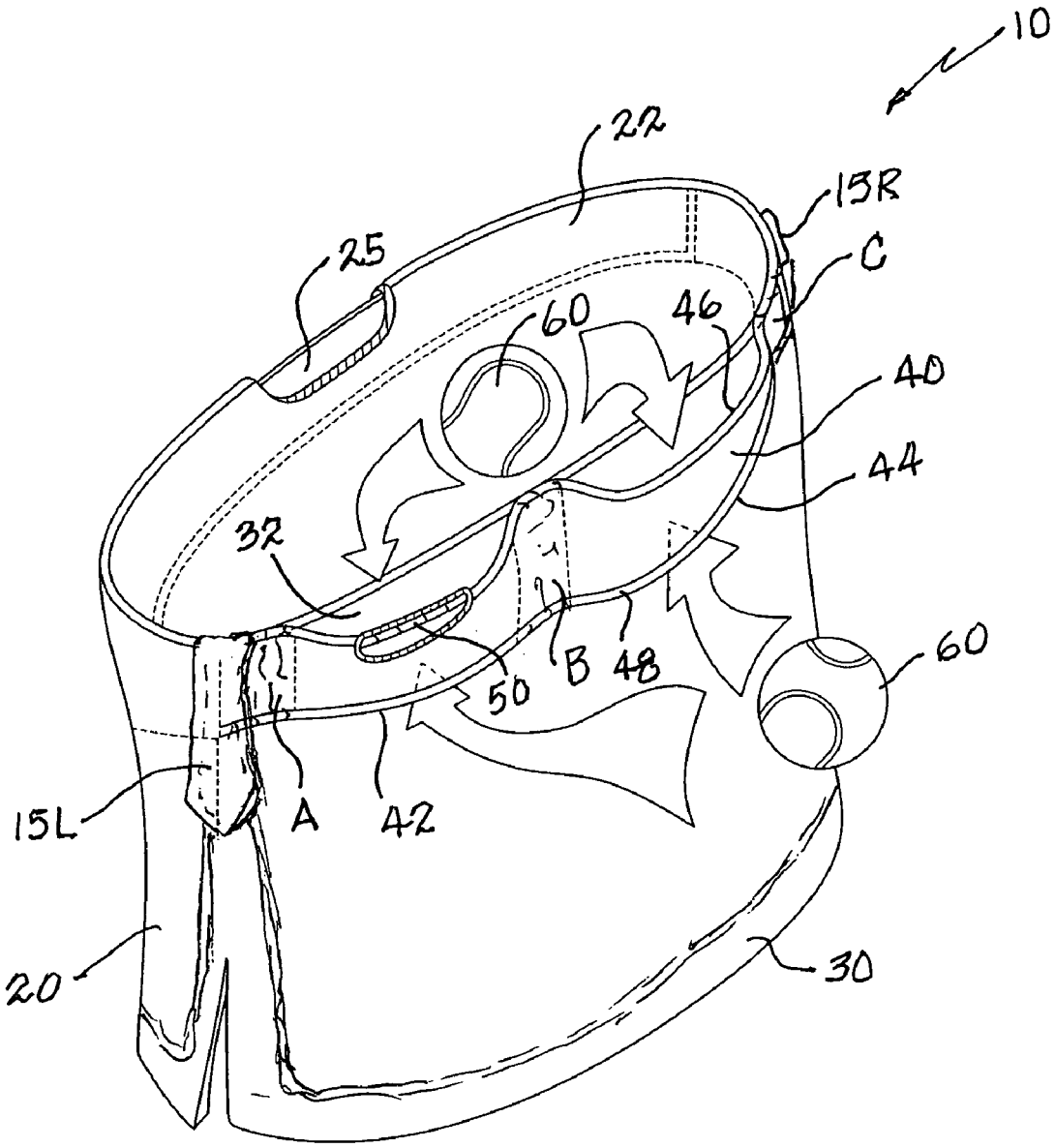
FIG. 6 is a side perspective view of the tennis skirt of FIG. 3 illustrating the means by which tennis balls may be inserted between a rear waistband and the ball securing sleeve.

A ball securing sleeve 40 is aligned with the rear waistband portion 32 as is best shown in FIG. 6. The ball securing sleeve 40 is joined (sewn) to the rear waistband 32 in three locations which are identified in FIG. 6 as "A," "B," and "C", that is a left, center, and right rear positions respectively. This establishes a left-rear 42 and right-rear 44 sections of the ball securing sleeve 40 which are unattached to the rear waistband 32. The ball securing sleeve 40 has upper 46 and lower 48 sleeve hems which secure elastic cords 50 there-within. As shown in FIGS. 2, 5 and 6 a tennis ball 60 may be placed between the rear waistband 32 and the ball securing sleeve 40 at the left-rear 42 and right-rear 44 sections of the ball securing sleeve 40, with the tennis ball 60 held in place by the elastic cords 50 and the fabric of the sleeve 40 between the upper 46 and lower 48 sleeve hems.

Preferably, the tennis garment 10 provides an elastic band 25, within the front 22 and rear 32 waistbands so as to provide a means for securing the waistband on the hips of the tennis player 5. A portion of the band 25 is shown in FIG. 6 as an example of how the band 25 is fixed within both front 22 and rear 32 portions of the waistband.

Preferably, the tennis garment 10 provides left 15L and right 15R side chevrons (FIGS. 2-5) positioned at opposing common left and right intersections of both the front and rear panels 20, 30 and the front and rear waistband portions 22, 32. The chevrons 15L, 16L provide support and strength to the garment 10 at its main sewn seams and also provides a visual cover, hiding the seams at left and right terminations of the ball securing sleeve 40.

Preferably, the ball securing sleeve 40 is 3 inches in width; see "W" in FIG. 2. The tennis ball 60 is approximately 2⅝ inches in diameter. Therefore, when the ball 60 is placed between band 32 and sleeve 40, the elastic cords 50 are positioned on opposing sides of the ball 60 and therefore, secure ball 60 in place. The fabric of band 40 assures that the ball 60 cannot be ejected between the elastic cords 50, as opposed to the apparatus of Carini where the ball 60 may be ejected. Sleeve 40 may vary in width "W" between 2 and 3 inches. In practice, a sleeve 40 of less than 2 inches in width requires elastic bands 25 to have elastic forces that require an uncomfortable level of finger strength to expand as shown in FIG. 6, when inserting and extracting the tennis ball 60. It has been found that the left-rear 42 and right-rear 44 sections must be between 2¾ and 3¼ inches in length, see "L" in FIG. 2, with a preferred length of 3 inches. When dimension "L" varies outside the range of 2¾ to 3¼ inches, the ball 60 is difficult to insert and remove, or is held too loosely and therefore may fall out of sleeve 40 during play. In securing the ball 60 in place, the elastic cords 50 must have an elastic constant of between 2 and 4 oz., per inch of elongation in order to meet the dual parameters of securing the ball in sleeve 40 during aggressive tennis play, while assuring ease of manual withdrawal from the sleeve when the ball is needed.

In the preferred embodiment of the present invention, when no ball 60 is secured within the sleeve 40, the elastic cords 50 are in a relatively relaxed attitude, but still maintain a small tension so that the sleeve 40 is held flush against the rear waistband portion 32. The sleeve 40 between the engagement positions "A" and "B" and also between the positions "B" and "C" in FIG. 1, is purposely made longer than length "L" (shown in FIG. 2) and therefore, sleeve 40 is in a gathered state when no ball is present. However, when a ball 60 is inserted into sleeve 40, elastic cords 50 stretch to admit the ball 60 and then elastically attempt to move to the relatively un-stretched state to clamp the ball 60 securely both above and below the ball 60. It is the un-gathered length of sleeve 40 that limits the amount of stretch elastic cords 50 may exhibit. This is critical for preventing excess cord stretch which can reduce the working ability and life of elastic cords in general. After a ball 60 has been inserted into sleeve 40, the elastic cords 50 hold the ball 60 in place by taking positions on opposing sides of the ball 60, while sleeve 40 moves back to a partially gathered state thereby offering a more significant barrier to the escape of ball 60 from the sleeve then when the upper 46 and lower 48 sleeve hems are not gathered.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A tennis garment of fabric material and sewn construction for use by a tennis player, the garment comprising:

a front fabric panel and a rear fabric panel, the fabric panels joined at opposing seams and to be positioned proximate hips of the tennis player;

a flexible waistband having a front waistband portion, and a rear waistband portion, the waistband portions joined together to encircle a waist of the tennis player, and further joined to top portions of the corresponding fabric panels;

a securing sleeve aligned with and overlying the entire rear waistband portion and joined thereto at left, center, and right mutual locations, while the securing sleeve is not joined to the rear waistband portion between the left and center mutual locations, and also is not joined to the rear waistband portion between the right and center mutual locations, thereby establishing rear-left and rear-right sections of the securing sleeve that are unattached to the rear portion of the waistband, thereby forming two ball sleeves for receiving tennis balls;

the securing sleeve having upper and lower sleeve hems each securing therein an elastic cord, the elastic cords having a slight tension when no tennis ball is inserted in the ball sleeves, thereby holding the securing sleeve against the rear waistband and the sleeve hems being fully gathered, while with a tennis ball inserted into at least one of the ball sleeves, the sleeve hems are partially gathered, the sleeve hems, when not gathered, setting a maximum stretch length of the elastic cords whereby overextension of the elastic cords is prevented.

2. The tennis garment of claim 1 configured as one of a tennis skirt, tennis shorts and a tennis dress.

3. The tennis garment of claim 1 wherein the securing sleeve is between 2 and 3 inches in width and wherein each one of the ball sleeves is between 2¾ and 3¼ inches in length.

4. A tennis garment of fabric material and sewn construction for use by a tennis player, the garment comprising:

a front fabric panel and a rear fabric panel, the fabric panels joined together to form a hip garment portion to encircle the hips of a tennis player;

a flexible waistband having a front waistband portion and a rear waistband portion, the waistband portions joined together and joined to top portions of the corresponding front and rear fabric panels to form a waist garment portion to encircle the waist of a tennis player;

a securing sleeve aligned with the rear waistband portion;

the securing sleeve comprising elastic material;

the securing sleeve overlying and joined to the entire rear waistband portion at left, center, and right mutual locations, not joined to the rear waistband portion between the left and center mutual locations and between the right and center mutual locations, and thereby establishing rear-left and rear-right sections of the securing sleeve and openings between top and bottom ends of each rear-left and rear-right section and the rear waistband portion;

the rear-left and rear-right sections each being sized for securing a tennis ball between each of the rear-left and rear-right sections and the rear waistband portion when the elastic material of the securing sleeve is expanded by stretching the elastic material;

the elastic material of the securing sleeve having flexibility to pass a tennis ball between the openings of each top and bottom ends;

the elastic material of the securing sleeve having tension to secure a tennis ball between each of the rear-left and rear-right sections and the rear waistband portion; and the elastic material of the securing sleeve having tension to hold each rear-left and rear-right section adjacent to the rear waistband portion when no tennis ball is secured therein.

5. The tennis garment of claim 1 wherein the securing sleeve is between 2 and 3 inches in width and wherein each one of the rear-left and rear-right sections is between 2¾ and 3¼ inches in length.

* * * * *